US005389239A

United States Patent [19]

Castagnos, Jr.

[11] Patent Number: 5,389,239

[45] Date of Patent: * Feb. 14, 1995

[54] CONTROL METHOD FOR DIRECT-COUPLED FCC RISER CYCLONE

[75] Inventor: Leonce F. Castagnos, Jr., The Woodlands, Tex.

[73] Assignee: Texaco Inc., White Plains, N.Y.

[ * ] Notice: The portion of the term of this patent subsequent to Sep. 28, 2010 has been disclaimed.

[21] Appl. No.: 155,356

[22] Filed: Nov. 22, 1993

[51] Int. Cl.[6] ..... C10G 11/18

[52] U.S. Cl. ..... 208/161; 208/113; 208/157; 208/164; 208/DIG. 1

[58] Field of Search ..... 208/113, 146, 152, 157, 208/161, 164, DIG. 1; 422/112, 110, 111, 113, 143, 147, 214, 142, 144

[56] References Cited

U.S. PATENT DOCUMENTS 4,288,235 9/1981 Gartside et al. ..... 55/196
4,433,984 2/1984 Gartside et al. ..... 55/196
4,502,947 3/1985 Haddad et al. ..... 208/161
4,623,446 11/1986 Haddad et al. ..... 208/113
4,737,346 4/1988 Haddad et al. ..... 422/144
5,248,411 9/1993 Chan ..... 208/161

*Primary Examiner*—Anthony McFarlane
*Assistant Examiner*—Bekir L. Yildirim
*Attorney, Agent, or Firm*—James L. Bailey; Kenneth R. Priem; Richard A. Morgan

[57] ABSTRACT

In a direct-coupled cyclone system, the riser cyclone is positioned external to a containment vessel. The riser cyclone separator discharges separated catalyst to a catalyst stripper internal to the containment vessel. Means is provided for withdrawing stripping gas from the catalyst stripper and passing it under pressure control to the riser cyclone separator. The riser cyclone separator is inherently pressure stable relative to the catalyst stripper. The invention is particularly useful for retrofitting a direct-coupled cyclone separator to a pre-existing containment vessel with limited free volume.

8 Claims, 1 Drawing Sheet

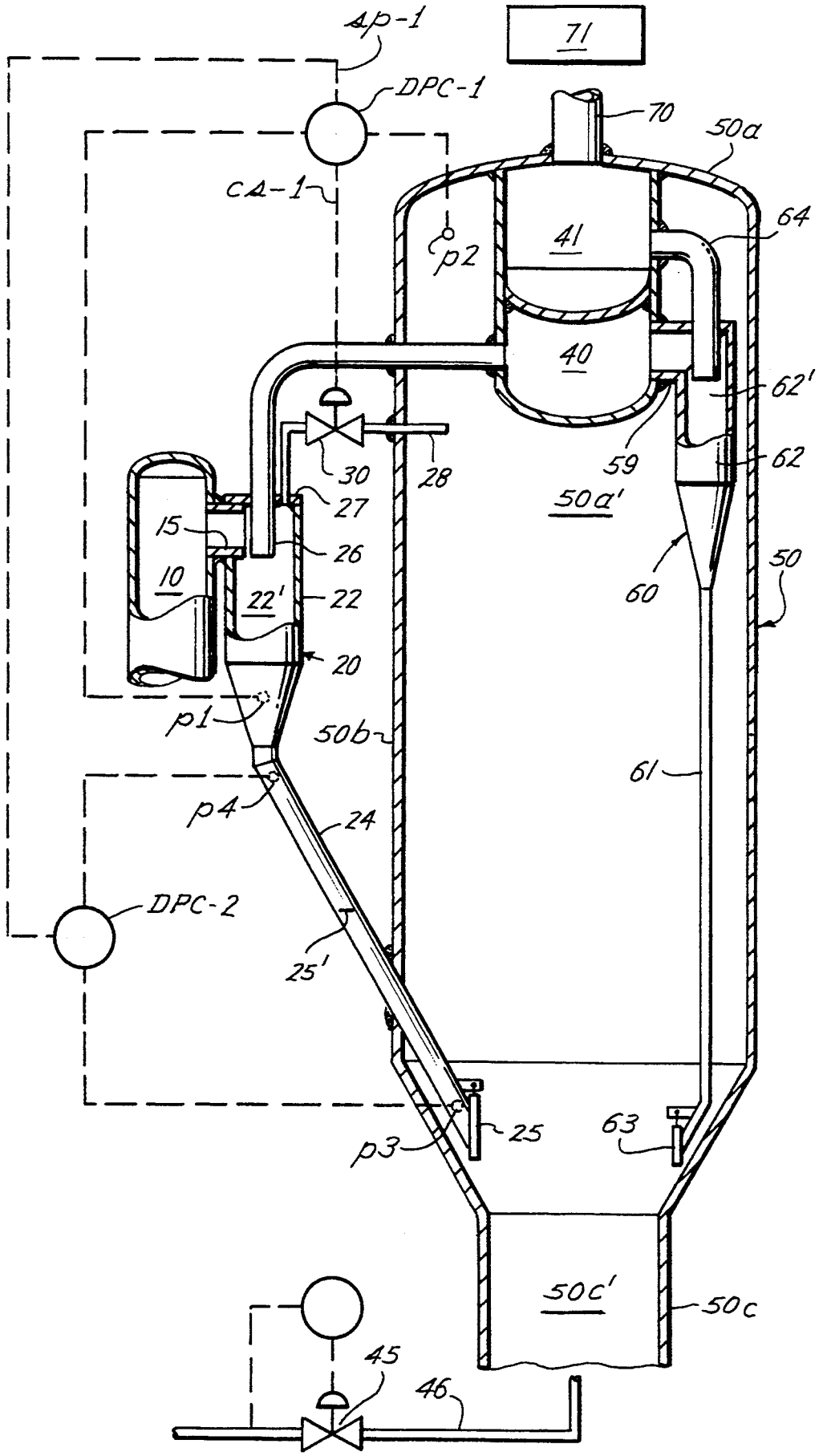
Δp-1
71
DPC-1
70
50a
CΔ-1
64
41
p2
40
62'
30
28
59
62
27
50a'
15
26
10
22'
22
60
50
20
p1
50b
61
p4
24
DPC-2
25'
25
63
p3
50c'
50c
45
46

CONTROL METHOD FOR DIRECT-COUPLED FCC RISER CYCLONE

BACKGROUND OF THE INVENTION

1. The Field of the Invention

The invention relates to a control method for a cyclone separator apparatus attached directly to a fluid catalytic cracking (FCC) riser reactor.

2. The Related Art

U.S. Pat. No. 5,248,411 describes an apparatus for rapidly separating catalyst from a cracked hydrocarbon gas in a fluidized catalytic cracking (FCC) unit. It also describes a process for withdrawing stripper gas from an FCC reactor vessel. A vent orifice for withdrawal of reactor and stripper gasses is located in an annular space formed around the riser cyclone outlet tube and the roof of the riser cyclone. The vent orifice provides pressure stability in a direct-coupled cyclone system.

The fluid catalytic cracking (FCC) process comprises mixing hot regenerated catalyst with a hydrocarbon feedstock in a transfer line riser reactor under catalytic cracking reaction conditions. The feedstock is cracked to yield gasoline boiling range hydrocarbon as well as degradation products, such as coke, which deposits on the catalyst causing a reduction in catalytic activity. Hydrocarbon vapor and coked catalyst are passed from the top of the riser reactor to a containment vessel, containing a cyclone separator, wherein catalyst is separated from hydrocarbon. In the art, the separator vessel is termed the reactor vessel or the disengager vessel. The separated catalyst is passed to a stripper, also in the containment vessel, and contacted with a stripping gas to remove volatile hydrocarbon. Stripped catalyst is then passed to a separate regeneration vessel wherein coke is removed from the catalyst by oxidation at a controlled rate. Catalyst, substantially freed of coke, is collected in a vertically oriented regenerated catalyst standpipe. The regenerated catalyst is passed from the standpipe to the riser reactor for cyclic reuse in the process.

A conventional fluid catalytic cracking (FCC) feedstock comprises any of the hydrocarbon fractions known to yield a liquid fuel boiling range fraction. These feedstocks include light and heavy gas oils, diesel, atmospheric residuum, vacuum residuum, naphtha such as low grade naphtha, coker gasoline, visbreaker gasoline and like fractions from steam cracking.

Catalyst development has improved the fluid catalytic cracking (FCC) process. High activity, selectivity and feedstock sensitivity are demonstrated by the new crystalline zeolite cracking catalysts. These high activity catalysts have been used to improve the yield of more desirable products.

The hydrocarbon conversion catalyst employed in a fluid catalytic cracking (FCC) process is preferably a high activity crystalline zeolite catalyst of a fluidizable particle size. The catalyst is transferred in suspension or dispersion with a hydrocarbon feedstock, upwardly through one or more riser conversion zones which provide a hydrocarbon residence time in each conversion zone in the range of 0.5 to about 10 seconds, typically less than about 8 seconds. High temperature riser hydrocarbon conversion occurs at temperatures of at least 900° F. (482° C.) up to about 1450° F. (788° C.), pressures of 5 psig (1.3 atm) to 45 psig (4 atm) and at 0.5 to 4 seconds hydrocarbon residence time with catalyst in the riser. The vaporous hydrocarbon conversion product is rapidly separated from catalyst.

In modern fluid catalytic cracking (FCC) units, cracking temperature has been increased to obtain high conversion of feedstock boiling range material to light products. Typical cracking temperatures in modern fluid catalytic cracking (FCC) units are in the range of 980° F. (526° C.) to 1050° F. (565° C.), or above. At these high temperatures, thermal degradation of cracked liquid products can be significant, resulting in formation of additional gaseous products and loss of valuable liquid products. In many cases the fluid catalytic cracking (FCC) unit capacity and operating severity are limited by the ability to compress and recover the light gaseous products.

Rapid separation of catalyst from hydrocarbon product is particularly desirable to limit hydrocarbon conversion time to the residence time in the riser conversion zone. During the hydrocarbon conversion, coke accumulates on the catalyst particles and entrains hydrocarbon vapors. Entrained hydrocarbon contact with the catalyst continues after removal from the hydrocarbon conversion zone until the hydrocarbon is separated from the catalyst. Allowing the catalytic reaction to proceed beyond the optimum contact time results in degradation of liquid products to less desirable gaseous products and coke.

Catalyst is separated from hydrocarbon by cyclone separating and then stripped with stripping gas to remove volatilizable hydrocarbon. Hydrocarbon conversion products and stripped hydrocarbon are combined and passed to a fractionation and vapor recovery system. This system comprises a fractionation tower, vapor coolers and wet gas compressor operated at a suction pressure of 0.5 psig (1.03 atm) to 10 psig (1.7 atm). Stripped catalyst containing deactivating amounts of coke, is passed to a catalyst regeneration zone.

One or more cyclone separators are used to provide a rapid, efficient separation of cracked hydrocarbon from catalyst particles at the outlet of the riser reactor. These cyclone separators, usually designated as riser our rough-cut cyclones, terminate the catalytic reactions taking place in the riser reactor. Riser cyclones may be either external, or more commonly, internal to the reactor vessel. The separated vapor from riser cyclones is typically discharged into the upper section of the reactor vessel and passed to one or more sets of secondary cyclones for removal of catalyst particles before the vapors enter the fractionation and vapor recovery system. In fluid catalytic cracking (FCC) units operating at cracking temperatures above about 980° F. (526° C.) significant thermal degradation of cracked products can occur when the vapors are allowed to enter the reactor vessel. To reduce thermal degradation of cracked products, direct-coupled or closed cyclone systems, such as disclosed in U.S. Pat. No. 5,248,411 have been used. In direct-coupled cyclones, the separated vapors from the riser cyclones are passed directly to the inlet of secondary cyclones. Direct-coupled cyclones reduce thermal degradation of cracked products by shortening the residence time of the vapor.

An object of the present invention is to provide a direct-coupled cyclone apparatus for rapidly separating the catalyst-hydrocarbon suspension and preventing thermal degradation of cracked products. Another object of this invention is to provide a direct-coupled cyclone system for use with riser cyclones external to the reactor or disengager vessel. And yet another object of this invention is to provide a control method to establish and maintain a stable pressure gradient between the riser cyclone barrel and the reactor vessel to facilitate removing stripper gas from the reactor vessel.

U.S. Pat. Nos. 4,623,446 and 4,737,346 to J. H. Haddad et al. teach a closed-coupled cyclone separator system in the reactor vessel of a fluid catalytic cracking apparatus. Means is provided for blending stripping gas with cracked hydrocarbon as it flows to a directly coupled riser cyclone separator.

U.S. Pat. No. 4,502,947 to Haddad et al. discloses a closed cyclone fluid catalytic cracking catalyst separation method and apparatus. In the closed cyclone, hydrocarbon product and catalyst are passed directly into a cyclone separator from a riser without passing into the atmosphere of the reactor vessel. Avoiding the atmosphere of the reactor vessel reduces both excess catalytic cracking and high temperature thermal cracking.

U.S. Pat. No. 5,221,301 to N. L. Giuricich discloses a multistage cyclone separator system with a plenum providing a manifold and structural support.

There is a need in the art to capture the process advantages of U.S. Pat. No. 5,248,411 in existing fluid catalytic cracking (FCC) reactor vessels where limited free volume restricts retrofit of a direct-coupled riser cyclone.

SUMMARY OF THE INVENTION

The invention is a control method for fluid catalytic cracking (FCC) a hydrocarbon feedstock. A fluid catalytic cracking (FCC) feedstock is contacted with a fluidized catalyst in a riser reaction zone at a catalytic reaction temperature and pressure to yield a reaction mixture.

The reaction mixture is discharged into a riser cyclone separation zone. The separation zone pressure is measured. The reaction mixture is separated at separation zone pressure to yield a cracked hydrocarbon vapor and a coked cracking catalyst. The cracked hydrocarbon vapor is withdrawn and passed through secondary cyclone separators to a fractionation and vapor recovery system.

The coked cracking catalyst is withdrawn and passed to the stripping zone, stripped with a fresh stripping gas and separated to yield stripped catalyst and spent stripping gas. The pressure of spent stripping gas is measured.

The spent stripping gas is then passed to the separation zone at a flow rate proportional to a difference between the separation pressure measurement and the spent stripping gas pressure measurement. As a result, a pressure differential is maintained between the separation pressure and the spent stripping gas pressure. Backflow from the separation zone to the stripping zone is prevented.

BRIEF DESCRIPTION OF THE DRAWING

The Drawing is a vertical section through a portion of a direct-coupled cyclone system incorporating the control method of the invention.

DETAILED DESCRIPTION 0F THE INVENTION

The invention will be described by way of example with reference to the Drawing. The Drawing is a representation of an apparatus for contacting a hydrocarbon feedstock with finely divided fluidized catalyst in riser reactor 10. A mixture of cracked hydrocarbon vapors and finely divided catalyst are discharged from riser reactor 10 via conduit 15 into riser cyclone separator 20.

Riser cyclone separator 20 is direct-coupled (closed-coupled) with secondary cyclone 60 by means of conduit 26 and plenum 40. Direct-coupling conduit 26 joins the two and is constructed as shown to enclose and completely separate the cracked hydrocarbon vapor and finely divided catalyst flowing therethrough from the surrounding atmosphere of reactor vessel 50.

Reactor vessel or reactor are terms used in the fluid catalytic cracking (FCC) art referring generally to the containment vessel for spent stripping gas. The reactor vessel is optionally also the containment vessel for the reaction mixture discharged from a fluid catalytic cracking (FCC) riser reactor or riser cyclone. In the Best Mode contemplated by inventor, riser cyclone separator 20 is external to reactor vessel 50. Inventor contemplates that this configuration would be used to retrofit a direct-coupled riser cyclone to a riser reactor in which a preexisting reactor vessel were limited in free volume.

Reactor vessel 50 comprises an upper end **50*a*, a sidewall 50*b* and a lower end 50*c*. Contained within upper end 50*a* is spent stripping gas containment zone 50*a*′ consisting of primary plenum 40 and secondary plenum 41. Within the lower end 50*c*, a catalyst stripping zone 50*c*′ occupies the internal volume of lower end 50*c* including contacting means such as baffles (not shown) facilitating the countercurrent contacting of catalyst. Stripping gas is provided via control valve 45 and conduit 46**. The amount of stripping gas provided is usually adjusted in proportion to the amount of catalyst flowing through the stripping zone and is typically in the range of 1 to 5 pounds of steam per 1000 pounds of catalyst.

Riser cyclone 20 comprises barrel 22, dipleg 24, top cover 27 and vapor outlet conduit 26. Barrel 22 contains separation zone 22′ providing separation of cracked hydrocarbon vapors from finely divided catalyst delivered via conduit 15. Separation pressure in separation zone 22′ is measured at point p1. Dipleg 24 traverses side wall **50*b*, conducting catalyst from barrel 22 to catalyst stripping zone 50*c*′. Separated catalyst falls by gravitational force from barrel 22 down dipleg 24. Flow is resisted by sealing means 25 attached to the lower end of dipleg 24. Sealing means 25 is typically a flapper valve as shown or a J-valve, trickle valve or the like. Sealing means 25 seals dipleg 24 from the flow of stripping gas up the dipleg 24, while allowing for the flow of catalyst to catalyst stripper 50*c*′. The difference in pressure between separation zone 22′ and reactor vessel 50 together with the resistance to flow from sealing means 25 cause catalyst to reside in the dipleg forming a catalyst head extending from sealing means 25 to catalyst level 25′**. The presence of the catalyst head is sensed by measuring the difference between the pressure at point p3 and point p4, typically 1 psig to 5 psig.

Cracked vapor is withdrawn from barrel 22 via vapor outlet conduit 26 traversing reactor vessel side wall **50*b*, and discharges into secondary cyclone 60 via plenum 40. Secondary cyclone 60 provides for additional removal of finely divided catalyst from cracked hydrocarbon vapors. Cracked vapors are delivered from plenum 40 to secondary cyclone 60 via conduit 59 to separation zone 62′. Separated catalyst falls by gravitational force from barrel 62 down dipleg 61. Sealing means 63, similar to sealing means 25, is attached to the lower end of dipleg 61**.

Spent stripping gas conduit 28 provides for the transport of spent stripping gas from stripping gas containment zone 50*a'* directly into the top cover 27 of riser cyclone 20. Stripping gas is withdrawn from separation zone 22' along with hydrocracked vapor via vapor outlet conduit 26. The pressure of spent stripping gas is measured at point p2 in stripping gas containment zone 50*a'*. The particular process benefits of such an arrangement are described in U.S. Pat. No. 5,248,411 incorporated herein by reference. Cracked vapor is withdrawn from barrel 62 via vapor outlet conduit 64 and discharges into outlet conduit 70 via plenum 41. Vapor recovery system 71 is in fluid communication with outlet conduit 70.

The relative proportion of cyclone separator members is known in the art. *Perry's Chemical Engineers' Handbook,* 4th ed., pp. 20–68 to 20–71 describes design parameters for cyclone separators used for separating solid particles from vapors. *Kirk-Othmer Encyclopedia of Chemical Technology,* 3rd ed., Vol. 1, pp. 667 to 672 describes design parameters for cyclone separators used for separating solid particles from gases.

The pressure in a fluid catalytic cracking reactor vessel ranges between 0.5 psig (1.03 atm) and 45 psig (4 atm), with 25 psig (2.7 atm) being typical. An open riser cyclone is one that discharges separated vapors directly into the reactor vessel. The pressure in an open riser cyclone is greater than the pressure in the reactor vessel. In contrast, it has been found advantageous to maintain the pressure in a direct-connected cyclone lower than that of the reactor vessel. The optimum pressure inside a direct-connected cyclone is typically 0.1 to 2 psi (0.007 to 0.14 atm) below that of the reactor vessel. The pressure gradient is maintained by the lower pressure of the vapor recovery system 71 in fluid communication with outlet conduit 70. This 0.1 to 2 psi (0.007 to 0.14 atm) pressure differential is the motive force which draws stripper gas into the riser cyclone. Typically, stripping gas flows through a second stage of cyclone separation as it is removed from the reactor vessel.

According to the invention the spent stripping gas pressure is measured at point p2. The separation pressure is measured at point p1. The separation pressure measurement is subtracted from the spent stripping gas pressure measurement in differential pressure controller DPC-1. Differential pressure controller DPC-1 provides a control signal cs-1 to control valve 30. Control signal cs-1 is proportional to the difference between the two measurements. A constant differential pressure is thereby maintained.

It is desirable for differential pressure controller DPC-2 to maintain a catalyst head in dipleg 24 sufficient to produce a differential pressure of 1 psi to 5 psi between point p3 and point p4. This control objective is achieved by providing set point signal sp-1 to differential pressure controller DPC-1.

Set point signal sp-1 increases the catalyst head differential pressure (p3 minus p4) as follows: In response to a decrease in catalyst head differential pressure, the magnitude of set point signal sp-1 increases. Control signal cs-1 causes control valve 30 to close, causing the differential pressure between riser cyclone separation zone 22' (point p1) and reactor vessel 50 (point p2) to increase. The increase in differential pressure causes catalyst level 25' to increase, thereby increasing head differential pressure (p3 minus p4) in dipleg 24.

Set point signal sp-1 decreases the catalyst head differential pressure (p3 minus p4) as follows. In response to an increase in catalyst head differential pressure, set point signal sp-1 decreases. Control signal cs-1 causes control valve 30 to open, causing the differential pressure between riser cyclone separation zone 22 (point p1) and reactor vessel 50 (point p2) to decrease. The decrease in differential pressure between points p1 and p2 causes catalyst level 25' to fall, thereby decreasing head differential pressure (p3 minus p4) in dipleg 24. thereby decreasing head differential pressure (p3 minus p4) in dipleg 24.

While particular embodiments of the invention have been described, it will be understood, of course, that the invention is not limited thereto since modifications may be made, and it is, therefore, contemplated to cover by the appended claims any such modifications as fall within the time spirit and scope of the invention.

What is claimed is:

1. A control method for fluid catalytic cracking a hydrocarbon feedstock comprising:

contacting the feedstock with fluidized cracking catalyst in a riser reaction zone at catalytic reaction temperature and reaction pressure thereby yielding a reaction mixture;

discharging the reaction mixture into a direct-coupled riser cyclone separation zone, and separating the reaction mixture at a separation pressure to yield a cracked hydrocarbon vapor and a coked cracking catalyst;

withdrawing the cracked hydrocarbon vapor from the separation zone;

measuring the separation pressure to produce a separation pressure measurement;

contacting the coked cracking catalyst with a stripping gas and separating to yield stripped catalyst and spent stripping gas;

measuring a spent stripping gas pressure to produce a spent stripping gas pressure measurement; and passing the spent stripping gas to the separation zone at a flow rate proportional to a measurement difference between the separation pressure measurement and the spent stripping gas pressure measurement, thereby maintaining a pressure differential between the separation pressure and the spent stripping gas pressure.

2. The control method of claim 1 wherein the separation pressure ranges from 0.1 psi to 2 psi below the spent stripping gas pressure.

3. The control method of claim 1 wherein the spent stripping gas pressure ranges from 0.5 psig to 45 psig.

4. The control method of claim 1 wherein the catalyst head pressure differential ranges from 1 psi to 5 psi.

5. A control method for fluid catalytic cracking a hydrocarbon feedstock comprising:

contacting the feedstock with fluidized cracking catalyst in a riser reaction zone at catalytic reaction temperature and reaction pressure thereby yielding a reaction mixture;

discharging the reaction mixture into a direct-coupled riser cyclone separation zone and separating the reaction mixture at a separation pressure to yield a cracked hydrocarbon vapor and a coked cracking catalyst;

withdrawing the cracked hydrocarbon vapor from the separation zone;

measuring the separation pressure to produce a separation pressure measurement;

withdrawing the coked cracking catalyst from the separation zone and accumulating the coked cracking catalyst in a vertically elongated dipleg to form a catalyst head;

measuring a differential pressure across the catalyst head to produce a catalyst head differential pressure measurement;

passing the coked cracking catalyst from the catalyst head to a stripping zone, contacting with a stripping gas and separating to yield stripped catalyst and spent stripping gas;

measuring a spent stripping gas pressure to produce a spent stripping gas pressure measurement;

passing the spent stripping gas to the separation zone at a flow rate proportional to the difference between the catalyst head differential pressure measurement and a pressure differential calculated by subtracting the separation pressure measurement from the spent stripping gas pressure measurement.

6. The control method of claim 5 wherein the separation pressure ranges from 0.1 psi to 2 psi below the spent stripping gas pressure.

7. The control method of claim 5 wherein the spent stripping gas pressure ranges from 0.5 psig to 45 psig.

8. The control method of claim 5 wherein the catalyst head pressure differential ranges from 1 psig to 5 psig.

* * * * *